US005245928A

United States Patent [19]

Jasper

[11] Patent Number: 5,245,928

[45] Date of Patent: Sep. 21, 1993

[54] SHIP SIGNATURE MODIFIER

[75] Inventor: Norman H. Jasper, Panama City, Fla.

[73] Assignee: The United States of America as represented by the Secretary of the Navy, Washington, D.C.

[21] Appl. No.: 780,616

[22] Filed: Nov. 27, 1968

[51] Int. Cl.[5] ..... B63G 9/02; H04K 3/00

[52] U.S. Cl. ..... 102/402; 367/1

[58] Field of Search ..... 114/235, 235.2, 244, 114/253; 340/4, 5, 5 D, 3 T; 367/1; 102/402

[56] References Cited

U.S. PATENT DOCUMENTS 2,969,036 1/1961 Brown ..... 114/235

*Primary Examiner*—Ian J. Lobo

*Attorney, Agent, or Firm*—William C. Townsend; Edward J. Connors, Jr.

[57] ABSTRACT

A unique system of disposition-controlled, water-filled, fabric bags is suspended from and towed beneath a ship to effect the modification of the inherent water pressure signature thereof and thus prevent detonation of a marine mine programmed to be exploded thereby.

14 Claims, 1 Drawing Sheet

SHIP SIGNATURE MODIFIER

The invention described herein may be manufactured and used by or for the Government of the United States of America for governmental purposes without the payment of any royalties thereon or therefor.

The present invention relates generally to marine mine defense systems and, in particular, is a system for disguising the pressure signature of a ship in such manner as to prevent detonation of a marine mine that is programmed to be exploded thereby as it passes thereover.

Heretofore, conventional mine sweeping operations have been applied to pressure responsive marine mines in an attempt to provide safe passage for ships or other marine vehicles, as they travel along their intended course. For example, preceding the traverse of any given body of water by a ship requiring protection from pressure responsive mines, a variety of marine mine sweeping vehicles may be driven thereover which have been structurally constructed to produce water pressure signatures that simulate those of the real ship or ships to be protected. As a result, any pressure responsive marine mines that happen to be located within the influence thereof are detonated thereby and thus rendered harmless to any real ship passing over that particular location at some subsequent time. Although satisfactory for some purposes, such method and means for neutralizing or destroying marine pressure mines to provide safe passage for ships usually leaves a great deal to be desired. In the first place, such mine sweeping operations must be effected prior to the arrival of the real ship or ships to be protected. Hence, an enemy who may be cognizant of the mine sweeping operation would be forewarned of the coming of a ship or other marine vehicle that most likely would be detrimental to them, and they could prepare to take other defensive or offensive action against it, which would obviously place it in greater jeopardy than it would be in without such forewarning. Moreover, in order to provide effective sweeping of such pressure responsive marine mines, a considerable amount of expensive minesweeping equipment, manpower, and time is required. Such equipment must be constructed, transported to the location involved, and then operated either directly or indirectly by trained personnel. Of course, due to the time element involved, the keeping of such minesweeping operations from coming to the attention of the enemy is highly improbable; consequently, such operations are usually hazardous to both the minesweeping apparatus and the people operating it. Therefore, it may readily be seen that when the circumstances are such as would allow it, it would definitely be desirable to change the water pressure of actual ships in such manner that they would not cause the detonation of pressure responsive marine mine and thereby eliminate the necessity of preceding them with minesweeping operations.

The subject invention is an attachment that may be mounted on a ship for the purpose of changing it water pressure signature, so that it may pass over pressure responsive marine mines without being harmed thereby. It not only obviates the necessity of prior mine sweeping under some circumstances, but it is also an improvement over similar devices of the prior art. This is true because, by comparison, it is simple to construct, it is rather easy to operate, and it provides protection for ships or other marine vehicles at such time when they could not be protected in any other way. Of course, as an ancillary benefit, it also provides a relatively easy way to vary the water pressure signature of a ship for any given purpose, be it military or otherwise.

It is, therefore, an object of this invention to provide an improved method and means for varying the water pressure signature of a ship or other marine vehicle.

Another object of this invention is to provide an improved method and means for disguising a ship's water pressure signature.

Still another object of this invention is to provide an improved system for increasing the safety of a ship passing through a marine mine field composed of pressure responsive mines.

A further object of this invention is to provide an improved, easily installed attachment for effectively changing the hull configuration of a ship or other marine vehicle.

Another object of this invention is to provide a ship water pressure signature changing attachment that may be adjustably disposed relative to the hull thereof, in order to optimize its effects for various ship speeds and water depths.

Another object of this invention is to provide an improved ship water pressure signature changing method and means that may be manually adjusted to provide safe passage of a ship while it is traveling over a large variety of marine pressure responsive mines.

Another object of this invention is to provide an improved ship signature disguising means that is easily and economically constructed, stored, maintained, and operated, and which is expendable, should the situation arise during ship maneuvers which would make it desirable to discard it at quick notice.

Another object of this invention is to provide an improved method and means which, under certain circumstances, substantially obviate the necessity of sweeping the pressure responsive mines of a marine mine field prior to the passage of a ship or other marine vehicle thereover.

Other objects and many of the attendant advantages will be readily appreciated as the subject invention becomes better understood by reference to the following detailed description, when considered in conjunction with the accompanying drawings wherein.

Figure 1:
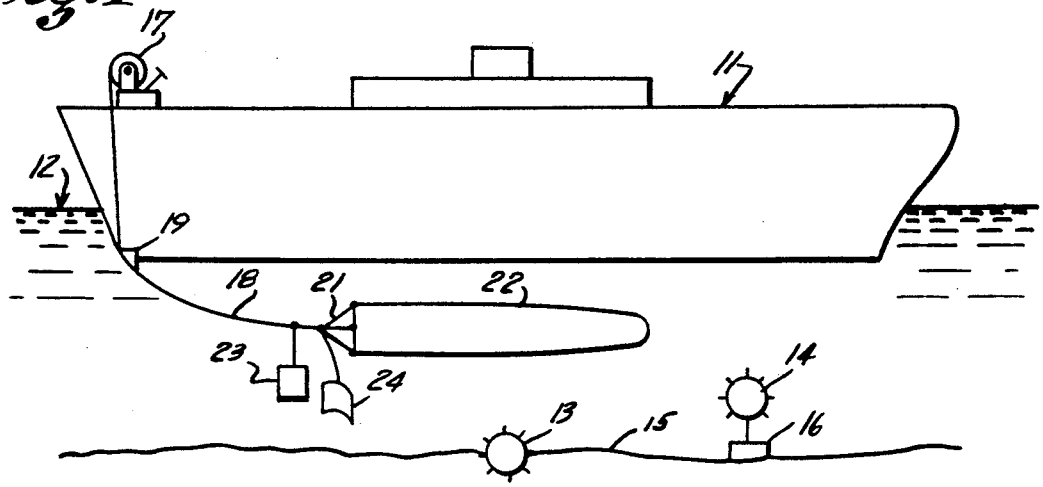
FIG. 1 is an elevational view of an exemplary preferred embodiment of the system constituting this invention.

Referring now to FIG. 1, there is shown a ship 11 which is intended to traverse various and sundry waterways 12 that are mined with programmed pressure responsive marine mines 13 and 14 that may be laying on sea floor 15 or tethered from an anchor 16, respectively.

It should be understood that ship 11 is shown in this particular instance in order to simplify the disclosure thereof, but that the subject invention is also susceptible to being installed on any other suitable marine vehicle, if so desired. Obviously, so doing would be well within the purview of one skilled in the art having the benefit of the teachings presented herewith.

A winch 17 capable of paying out and reeling in a tow cable 18 is mounted on the deck or other appropriate location of ship 11. Cable 18 is suspended from winch 17 and is threaded over a predisposed cable retention stop or bearing 19, preferably located at the lowest bow extremity of ship 11. Bearing 19 may have any suitable structural configuration—such as, for example, an appropriate hook configuration—which will enable one or more cables to slide thereover without being released therefrom and still allow the remainder of the invention to be withdrawn from the water when necessary.

Cable 18 extends rearwardly under ship 11 and is connected by means of a bridle 21 to a fabric bag 22. Attached to cable 18 may be a diverter 23 and a depressor 24, which are used to apply forces thereto in such manner as to properly position bag 22 under or substantially under ship 11, as it is being pulled along underwater thereby.

Bag 22 is an unusual type bag. Actually, it is somewhat like a wind sock and could perhaps be considered as being a water sock. Suffice to say at this time, it is preferably made of fabric and allows water to flow into it to maintain an inflated shape, as it is being pulled through the water. Further detailed thereof will be given subsequently in conjunction with the disclosure of the device of FIG. 3.

Figure 2:
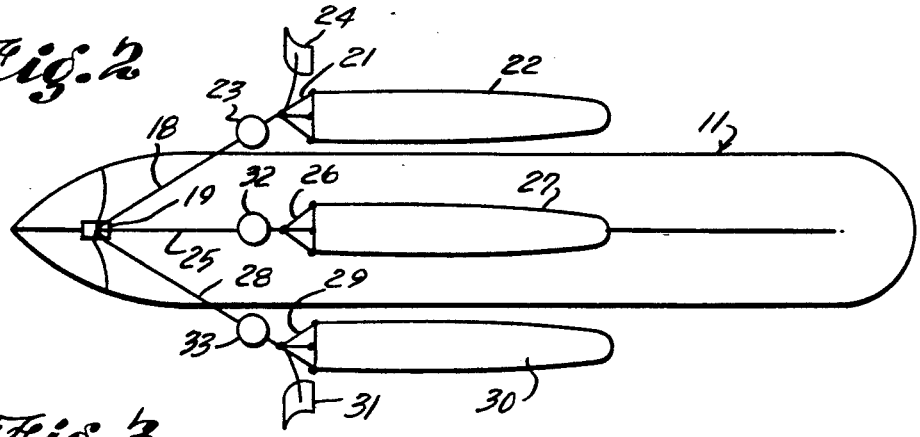
FIG. 2 is a bottom view of the exemplary system of FIG. 1.

As depicted in the elevational view of FIG. 1, only one bag 22 and towing cable 18 are seen as being used; however, it should be understood that any number of bags and towing cables may be combined without violating the scope of the system constituting the subject invention. For example, three such bags and tow cables are illustrated in FIG. 2. Of course, when FIG. 2 is considered as the bottom view of FIG. 1, then the system of FIG. 1 contains said three bags and towing cables, even through only one bag and one towing cable are visible therein.

Assuming for the sake of disclosing a simple preferred embodiment of the invention that FIG. 2 is a bottom view of FIG. 1, then tow cable 18, bridle 21, bag 22, and diverter 23 are also incorporated in its system. In addition, another tow cable 25, bridle 26, and bag 27 are included therein, and still another tow cable 28, bridle 29, and bag 30 are, likewise, included therein. And since it is desirable that bags 22 and 30 be outwardly disposed from center bag 27, the aforementioned diverter 23 and another diverter 31 are appropriately attached to cables 18 and 28, respectively, so as to apply the proper vector forces to bags 22 and 30 to position them accordingly.

Depending on the ship hull involved and the pressure signature wanted, cables 18, 25, and 28 may be paid out by winch 17 to position bags 22, 27, and 30 at whatever distance behind the bow and at whatever distance below the hull of ship 11 as is necessary during any given operational circumstances. The latter parameter would also be controlled to a considerable extent by the aforementioned depressor 24, as well as a pair of depressors 32 and 33, respectively connected to tow cables 18, 25, and 28.

Again, it should be understood that any number or combination of bags and associated disposition control apparatus may be employed that will facilitate provided protection to ship 11. Hence, for instance, bag 27 and its associated apparatus could be the entire system or could be deleted from the system. Or, in the alternative, either or both of bags 22 and 30 could be deleted from the system, depending on the water pressure signature desired for any given operational circumstances.

Figure 3:
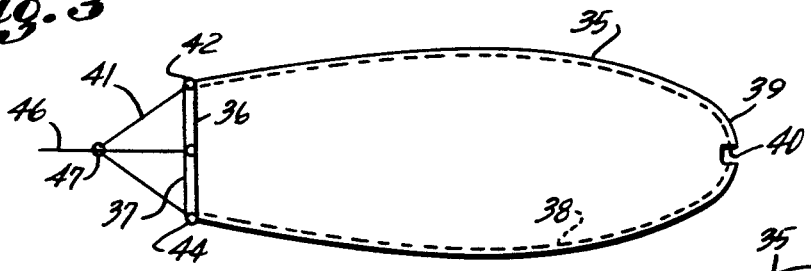
FIG. 3 is an elevational view of a bag that may be used in the system of FIGS. 1 and 2.
Figure 4:
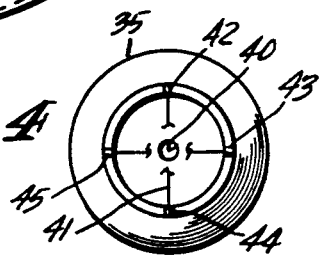
FIG. 4 is a front view of the bag of FIG. 3.

FIGS. 3 and 4 disclose representative side and end views, respectively, of a bag 35 that may be used as the aforesaid bags 22, 27, and 30. It is preferably made of fabric, and included therein is a stiffner 36 which may take the form of a roll of cloth, a plastic ring, or the like. The purpose of stiffner 36, of course, is to hold the front end 37 open in such manner as to enable it to scoop water into the remainder of the bag. The fabric walls 38 are shaped for best hydrodynamic performance, and the rear end 39 thereof may have a small diameter opening 40 located therein. However, it should be understood that said rear end opening is not essential to the functioning of the bag, and, thus, may be considered as being optional. In the event opening 40 is incorporated in the aft end 39 of bag 35, it will ordinarily releave some of the hydrodynamic stresses occurring therein, while it is being pulled through the water; furthermore, it will usually facilitate withdrawing the bag from the water after operations are completed, because it acts as a drain hole through which the water is removed therefrom.

In this particular disclosure, the thickness of wall 38 is somewhat exaggerated; however, any suitable thickness that provides the proper operation may be used.

A bridle 41 is depicted as being attached to the front end 37 at four places 42, 43, 44, and 45, but any other configuration that provides uniformity of towing pull and stability of the bag may be employed. A towing cable 46, similar to cable 18 above, is connected at a suitable control point 47 on said bridle 41.

It was suggested above that bag 35 preferably be made of fabric; on the other hand, it should be understood that the invention is not intended to be limited thereto. For example, bag 35 may be made of any suitable flexible material, such as fiberglass, paper, cloth, plastic, canvas, or the like. As a general rule, it is also preferable that said bag material be of a non-magnetic type.

In like manner, the aforementioned tow cables 18, 25, and 28 should preferably be made of non-magnetic materials, so as not to adversely affect the safety of the ship with respect to other marine mines—such as, for instance, magnetic responsive marine mines. Likewise, any and all positioning apparatus, such as the aforesaid diverters and depressors, are preferably non-magnetic. However, in the event magnetic mines need not be taken into consideration or the subject system is part of an overall ship magnetic system, any or all of the components thereof may be made of magnetic materials or any other materials suitable for such purpose.

Figure 5:
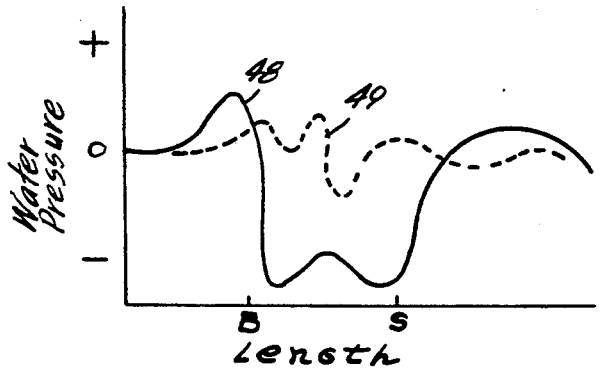
FIG. 5 is a graphical representation of hypothetical ship signatures with and without the subject invention attached thereto.

FIG. 5 is incorporated herewith in order to illustrate a theoretical comparison between the signature of a ship with and without the subject invention attached thereto. Solid line curve 48 illustrates a typical water pressure signature of a ship or the like without the invention attached thereto, and dashed line curve 49 depicts a hypothetical water pressure signature which might occur, if the same ship has the invention attached thereto. Obviously, the difference in pressure signatures is considerable and, consequently, the changed pressure signature, effected by the invention, may be employed to disguise the real or inherent signature of the ship.

The operation of the invention will now be discussed briefly in conjunction with all of the figures of the drawing.

As a ship travels through the water on its desired course, the pressure of the water beneath it varies, depending on the length, geometrical configuration, weight, and speed thereof. Such a variation is defined in the art as being the signature of the ship. Obviously, such signature is different for each ship design and may, from time to time, vary for the same ship, in the event its loading, speed, and other conditions are varied. Nevertheless, many ships (or other marine vehicles) are sufficiently similar in signature that marine mines have been designed to be detonated in response thereto, when it is desired to sink or otherwise disable them during war time. On the other hand, it may readily be seen that mines may also be programmed not to explode in response to certain ship signatures and to explode in response to others. This invention has, therefore, been made in an attempt to deceive the enemy mines that would otherwise destroy or disable friendly ships, so as to allow their safe passage through a mine field composed thereof. Of course, it may also be used indirectly with U.S. mines to destroy enemy ships having a signature somewhat similar to U.S. ships not incorporating the invention, while allowing safe passage for U.S ships which have the system constituting the subject invention installed thereon.

The particular water pressure signature effected by this invention is contingent upon the number and disposition of bags hung immediately under and/or sidewardly and downwardly extending from any given ship. Hence, a different signature would result if only one bag is used instead of three, as is shown in FIG. 2. Moreover, a different signature would be effected if only two of the bags were used, regardless of which two were selected. Furthermore, the distance aft of the ship's bow and the distance beneath the ship's hull at which the bag or bags are positioned make a difference in the signature produced thereby. Of course, the particular arrangement selected would depend on the ship involved and its operational circumstances. In any event, the proper employment of any number of bags of predetermined size and shape (perhaps even more than three, if necessary) changes the water pressure signature of any given ship.

Because it is not uncommon to tow various and sundry devices, bags, etc., fore or aft of ships performing functions other than those herewith described, such things should be distinguished from the subject invention. For example, it is well known to tow large wind sock-like bags under the water behind a marine vehicle for the purpose of simulating a ship signature and thus effecting the detonation of pressure responsive mines. In those instances, however, the purpose thereof is to explode said mines, rather than to provide safe passage thereover, as is the case with the subject system. Furthermore, in such mine sweeping operations, it should be noted that the bags or other devices are towed at one or more positions that are relatively remote from the towing vessel, and, in fact, the only reason a towing vessel is present at all is to provide a tractor means to move the towed bags or other devices through the water. The subject invention, on the other hand, requires that the bag or bags be towed within the immediate vicinity of the underside of the ship, so that its inherent signature will be modified sufficiently to prevent the detonation of any pressure responsive marine mine designed to explode in response to a similar normal ship signature. This difference is exceedingly important, because it enables the subject invention to meet the paramount test for invention, viz., that it is a new and useful system that produces a new and useful result.

During actual operation, as the ship travels along its desired course, the bag or bags suspended thereunder fill with water and thus produce a physical body or bodies which effectively combine with the ship's hull to produce a new overall pressure signature. Because the bag or bags are constructed with open front ends, water flows into them and inflates them to produce semi-flexible, relatively large volume bodies which effectively displace an amount of water under the ship that is substantially equal to the total volume thereof. It is this new total effective volume of "displaced" water that combines with the displaced water volume of the ship's hull to effectively produce a different hull configuration that generates a new pressure signature for any given ship.

When not in use, being made of fabric and flexible cables, etc., the invention is portable and easily stored until such time as it is needed to provide safe passage for the ship. And when such occasion does arise, it is readily installed under the ship by operating which 17 to pay out the tow cables in such manner that the bags and associated position control accessories will effectively be towed from the aforesaid predetermined cable retaining bearing point 19, located substantially at the lowest bow point of the ship.

As shown in FIG. 5, water pressure is plotted against the distance over which said pressure is measured as a ship passes by. Such water pressure is measured at some location—usually on or near the sea floor—where pressure responsive marine mines are ordinarily located during war time. The distance over which it is measured is, of course, contingent on the size of the ships involved; but in FIG. 5, the terms B and S respectively refer to the bow and stern locations of a hypothetical ship of any size and are employed therein to illustrate how signatures 48 and 49, the inherent and modified signatures thereof, relate thereto. Obviously, it is the difference between the pressure of curve 48 and the pressure of curve 49 which facilitates the safe passage of any given ship or other marine vehicle over any marine mines 13 and 16 that are programmed to explode in response to the inherent signature 48 thereof.

In view of the foregoing, it ostensively may be seen that the subject invention provides a unique safety feature for ships traveling over pressure responsive marine mines and, hence, an advance in the art is effected thereby.

What is claimed is:

1. A marine vehicle water pressure signature modification system comprising in combination:

hollow, flexible, water-inflatable means capable of being inflated to a predetermined volumetric configuration by water being forced into the hollow thereof, as it is being towed therein;

a marine vehicle having a predetermined hull configuration; and means effectively connected between said marine vehicle and the aforesaid hollow, flexible, water-inflatable means for the towing thereof at a predetermined water depth from the bottom of said marine vehicle and at a given intermediate position between the bow and stern thereof.

2. The system of claim 1 further characterized by an exit hole located in the aft end of said hollow, flexible, waterinflatable means capable of being inflated to a predetermined volumetric configuration by water being forced into the hollow thereof, as it is being towed therein, with the size of said exit hole being smaller than the size of the entrance through which said water passes as it is being forced into the aforesaid hollow thereof.

3. The system of claim 1 wherein said marine vehicle having a predetermined hull configuration is a ship.

4. The system of claim 1 wherein said hollow, flexible, water-inflatable means capable of being inflated to a predetermined volumetric configuration by water being forced into the hollow thereof, as it is being towed therein comprises an elongated bag having an open front end and a closed aft end.

5. The system of claim 1 wherein said hollow, flexible, water-inflatable means capable of being inflated to a predetermined volumetric configuration of water being forced into the hollow thereof, as it is being towed therein comprises:

an elongated bag having a longitudinal axis of revolution;

a passageway extending through said elongated bag along the longitudinal axis of revolution thereof, with the forward entrance thereof having a larger diameter than the rearward exit thereof; and means mounted in contiguous disposition with the forward entrance of said passageway for the maintenance thereof in a substantially open configuration.

6. The system of claim 1 wherein said hollow, flexible, water-inflatable means capable of being inflated to a predetermined volumetric configuration of water being forced into the hollow thereof, as it is being towed therein comprises a plurality of bags, each of which has an open front end and a closed aft end.

7. The system of claim 1 wherein said hollow, flexible, water-inflatable means capable of being inflated to a predetermined volumetric configuration by water being forced into the hollow thereof as it is being towed therein comprises a plurality of elongated bags, each of which includes:

a longitudinal axis of revolution;

a passageway extending therethrough along the longitudinal axis of revolution thereof, with the forward entrance of said tapered passageway having a larger diameter than the rearward exit thereof; and means mounted in contiguous disposition with the forward entrance of said passageway for the maintenance thereof in a substantially open configuration.

8. The system of claim 1 wherein said means effectively connected between said marine vehicle and the aforesaid hollow, flexible, water-inflatable means for the towing thereof at a predetermined water depth from the bottom of said marine vehicle and at a given intermediate position between the bow and stern thereof comprises:

a tow cable; and means effectively connected to said tow cable for the urging thereof toward a predetermined position as a result of said tow cable being pulled through the water by the aforesaid marine vehicle.

9. The system of claim 8 further characterized by a winch connected between the forward end of said tow cable and said marine vehicle.

10. The system of claim 8 further characterized by a bridle connected between the aft end of said tow cable and the forward end of the aforesaid hollow, flexible, water-inflatable means.

11. The system of claim 1 wherein said means effectively connected between said marine vehicle and the aforesaid hollow, flexible, water-inflatable means for the towing thereof at a predetermined water depth from the bottom of said marine vehicle and at a given position between the bow and stern thereof comprises:

a plurality of tow cables; and means effectively connected to each of said tow cables for the respective urging thereof toward predetermined positions as a result of said tow cables being pulled through the water by the aforesaid marine vehicle.

12. The system of claim 11 further characterized by a winch connected between the forward ends of said plurality of tow cables and said marine vehicle.

13. The system of claim 11 further characterized by a plurality of bridles connected between the aft ends of said plurality of tow cables and the forward ends of the aforesaid hollow, flexible, water-inflatable means, respectively.

14. A method of modifying the water pressure signature of a marine vehicle comprising the steps of:

disposing at least one open-ended, elongated, flexible bag, having a forward open end that is larger than the aft open end thereof, substantially under the marine vehicle the water pressure signature of which is to be modified, with the longitudinal axis thereof substantially parallel to the direction of travel of said vehicle;

driving the marine vehicle, the water pressure signature of which is to be modified, along a given course; and towing said bag from a predetermined control position on said marine vehicle in such manner that it fills and inflates with water as said water flows therethrough and substantially maintains the aforesaid disposition in said inflated condition as said marine vehicle is driven along its given course.

* * * * *